US009757781B2

(12) United States Patent
Lai

(10) Patent No.: US 9,757,781 B2
(45) Date of Patent: Sep. 12, 2017

(54) METAL STRIPS STRAIGHTENING MACHINE

(71) Applicant: Ching Chung Lai, Hong Kong (HK)

(72) Inventor: Ching Chung Lai, Hong Kong (HK)

( * ) Notice: Subject to any disclaimer, the term of this patent is extended or adjusted under 35 U.S.C. 154(b) by 203 days.

(21) Appl. No.: 14/692,740

(22) Filed: Apr. 22, 2015

(65) Prior Publication Data

US 2016/0311004 A1 Oct. 27, 2016

(51) Int. Cl.

| | |
|---|---|
| ***B21D 1/02*** | (2006.01) |
| ***B21D 1/00*** | (2006.01) |
| ***B21D 3/00*** | (2006.01) |
| ***B21D 3/02*** | (2006.01) |
| ***B21D 43/00*** | (2006.01) |
| ***B21F 1/02*** | (2006.01) |
| *B21D 37/14* | (2006.01) |

(52) U.S. Cl.

CPC ..... *B21D 1/02* (2013.01); *B21D 1/00* (2013.01); *B21D 3/00* (2013.01); *B21D 3/02* (2013.01); *B21D 43/006* (2013.01); *B21F 1/02* (2013.01); *B21D 37/14* (2013.01)

(58) Field of Classification Search

CPC ... B21D 1/02; B21D 3/02; B21D 3/05; B21D 7/085; B21D 7/08; B21D 3/04; B21F 1/02

USPC ..... 72/190, 191, 192, 194, 196

See application file for complete search history.

(56) References Cited

U.S. PATENT DOCUMENTS

| | | | | |
|---|---|---|---|---|
| 1,458,381 | A * | 6/1923 | Baehr | B21B 1/163 72/194 |
| 3,345,847 | A * | 10/1967 | Schmitt | B21D 3/05 72/224 |
| 3,439,519 | A * | 4/1969 | Gerding | B21B 1/42 72/189 |
| 2002/0162373 | A1* | 11/2002 | Schramm | B21D 3/05 72/162 |
| 2011/0138868 | A1 | 6/2011 | HorstBraeutigam | |
| 2014/0150512 | A1* | 6/2014 | Murphy | B21D 3/05 72/162 |

* cited by examiner

*Primary Examiner* — Edward Tolan
*Assistant Examiner* — Mohammad Yusuf

(57) ABSTRACT

The present invention is directed to an improved metal strips straightener, including an infeed device and a pressure frame. The infeed device has one or more leveling rollers, and the pressure frame has a roller frame. The roller frame has one or more roller blocks to bring a metal strip into a upward full encirclement wrap. Each roller block is attached with a camshaft, where each camshaft is connected to a motorized drive system. Rotation of the camshafts actuates the roller blocks to move the metal strips, applying pressure on the metal strips during the passing through of the roller blocks. A closing cylinder is attached to one end of a roller block, where the closing cylinder has a convex contact surface. Multiple roller blocks are connected to each adjacent roller blocks via their connected closing cylinders.

7 Claims, 6 Drawing Sheets

METAL STRIPS STRAIGHTENING MACHINE

FIELD OF THE INVENTION

The present invention relates to an apparatus for manufacturing and, more particularly, to a straightening machine for straightening metal strips processing.

BACKGROUND OF THE INVENTION

Metal strips that are used in construction are typically first manufactured in coils, and then bent into various shapes for application.

In application and treatment of metal strips, the strips are typically delivered for further processing and treatment. One previously known method is to convey the strips by using unwinding reels, to turn the initial coiled strips into a flat state. This has a drawback of difficulty of feeding metal strips into the straighteners, and also difficult to straighten metal strips of irregular varying thickness.

Another previously known method is to use two rows of leveling rollers. This method has the drawback of large amount of deformation from the surface of the metal strips, and also producing a high noise volume during processing. In addition, because of the large amount of friction involved during processing, resulting in rapid wear and tear on the leveling rollers, and thus requires frequent repairs and parts replacement, increasing operating and maintenance costs.

SUMMARY OF THE INVENTION

The present invention is directed to an improved metal strips straightener, including a motorized drive system, an infeed device, one or more roller blocks, and an outfeed device, where the motorized drive system moves a metal strip in to the infeed device, through the roller blocks, and exit out of the outfeed device. The motorized drive system actuates the roller blocks to alternate between a leveling position and a retracted position, thereby asserting pressure on the metal strip while at the leveling position, and releasing pressure while at the retracted position.

Each roller block includes a leveling cassette and a holster, where the leveling cassette and the holster together form an opening for the passage of the metal strip. It has been contemplated to have a gap control located in between the leveling cassette and the holster, where an adjusting screw is connected to a hole on the holster by going through a bolt support with a slot located on the leveling cassette. It is further contemplated that the screw is held in position by using a U-shaped slot and two outer knurled rings rigidly connected to both ends of the screw.

Among the many different possibilities contemplated, support rollers are provided to the roller blocks by connecting to the included holsters. Further, four roller blocks are connected to position surrounding the metal strip at exactly a 90-degrees angle next to each adjacent roller blocks. Even further, a belt transmission is used to connect the motorized drive system to a camshaft, where a chain drive is used to connect to the camshaft to the infeed device, it has also been contemplated to include a bearing block for support of the camshaft, where the bearing block is included in a pressure frame connected to the infeed device and the outfeed device.

DETAILED DESCRIPTION OF THE INVENTION

Before the present invention is described in further detail, it is to be understood that the invention is not limited to the particular embodiments described, as such may, of course, vary. It is also to be understood that the terminology used herein is for the purpose of describing particular embodiments only, and is not intended to be limiting, since the scope of the present invention will be limited only by the appended claims.

Figure 1:
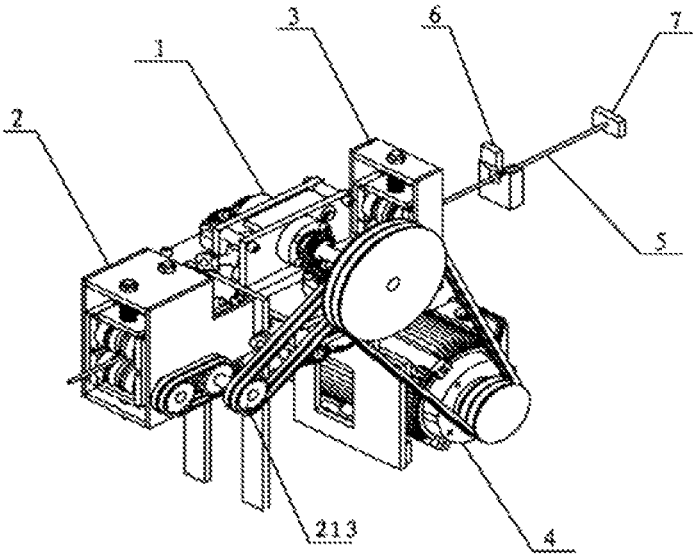
FIG. 1 shows a structural view of the invention from the infeed side.
Figure 2:
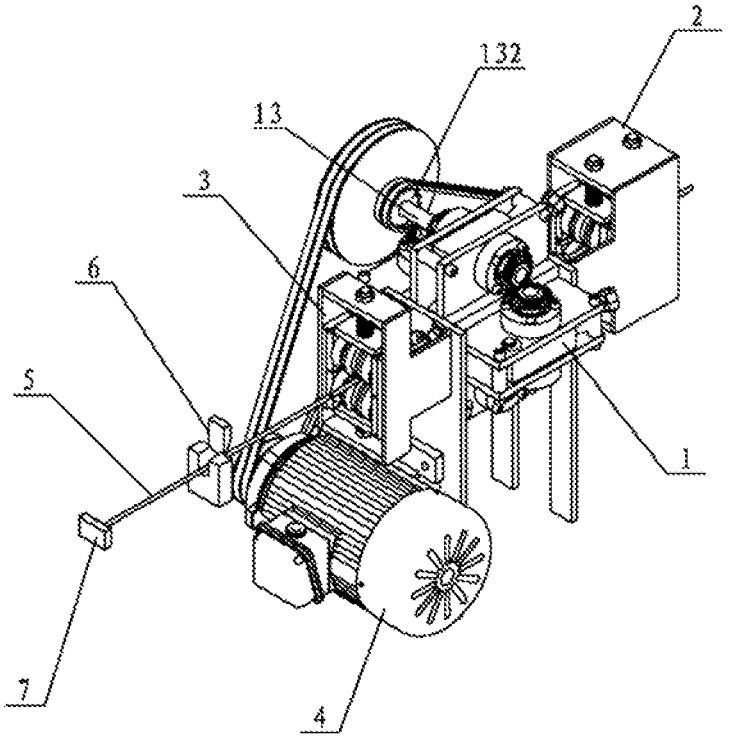
FIG. 2 shows a structural view of the invention from the outfeed side.

FIG. 1 and FIG. 2 illustrate a preferred embodiment of the current invention of improved metal strip straightening machine. The machine includes an infeed device 2, a pressure frame 1, and an outfeed device 3, arranged in the specified order to facilitate moving of a metal strip 5 in the same direction. In the preferred embodiment, a motorized drive system is connected to the infeed device 2 to drive the moving of the metal strip 5 toward the direction of the pressure frame 1. The outfeed device 3 is positioned to align in the same direction of the infeed device 2 to help guide the metal strip 5 moving in one linear direction through the pressure frame 1 located in between the infeed device 2 and the outfeed device 3. The pressure frame 1 asserts intermittent pressure onto the metal strip 5 during the pass through.

Figure 3:
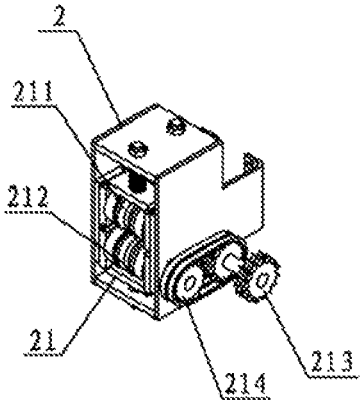
FIG. 3 shows a structural view of an infeed device.
Figure 4:
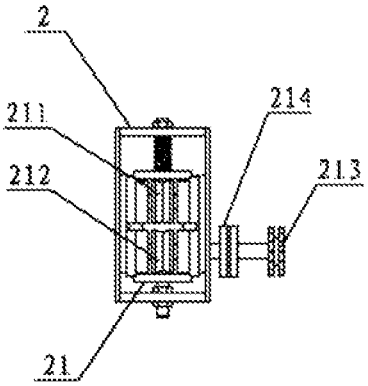
FIG. 4 shows a sectioned front view of an infeed device.

FIG. 3 and FIG. 4 illustrate an infeed device 2 attached to one or more leveling rollers 21. In the preferred embodiment, two leveling rollers 21 are used, wherein each leveling roller 21 includes an upper roller 211 and a lower roller 212. A sprocket 213 is used for connecting a motorized drive system to either one of the lower rollers 212 via an attached rotation arm. One or more lower rollers 212 are connected through linked gears 214 to drive all rollers into movement. The metal strip 5 goes through in between the upper rollers 211 and the lower rollers 212, and is driven into movement by the lower rollers 212.

While a sprocket 213 is used in the preferred embodiment, other alternatives have also been contemplated, including using a belt drive, and also using a gear drive, to achieve the same result of driving the movement of the metal strip 5.

Figure 5:
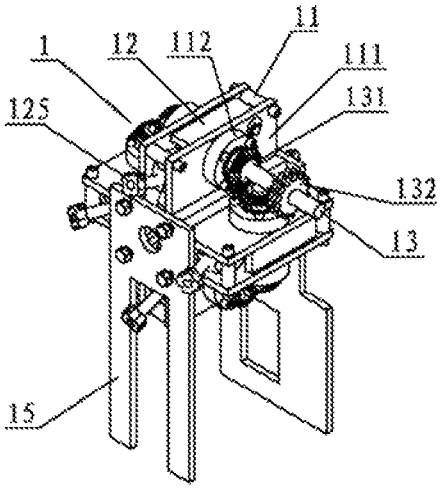
FIG. 5 shows an assembly drawing of a pressure frame.
Figure 6:
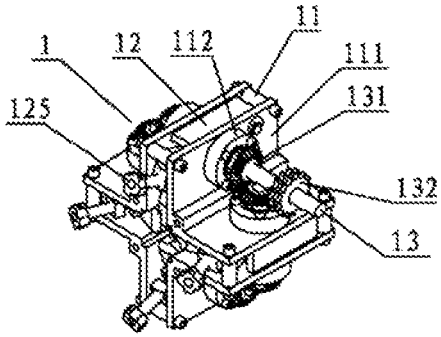
FIG. 6 shows a structural view of a pressure frame.

FIG. 5 and FIG. 6 illustrate a roller frame 11 also included in the pressure frame 1, wherein the roller frame 11 has four L-shaped support beams 111 assembled by screwing into the roller frame 11. Supporting plates 16 are used on each side to connect the pressure frame 1 to the infeed device 2 and the outfeed device 3. The roller frame 11 can have a plurality of roller blocks 12. In the preferred embodiment, four roller blocks 12 are used, installed to locate at the four corners surrounding the metal strip 5 from equal distance, where the interior angle between each pair of roller blocks 12 is exactly a 90-degrees angle. A roller block 12 has a camshaft 13 with saw teeth 131. Multiple roller blocks 12 are linked to move as a series via the saw teeth 131 on the camshafts 13. The motorized drive system is connected to actuate any one of the camshafts 13, to in turn drive all linked roller blocks 12 to move in repeated motion along the direction of the roller frame 11. Subsequently, the repeated movements of the roller blocks 12 assert pressures onto the metal strip 5 for straightening purpose.

Bevel gears have been contemplated to use in the preferred embodiment, so that the shafts intersect and the shapes of the tooth-bearing surfaces are conical, and mounted apart at a 90-degrees angle. This is illustrated in FIG. 6.

Furthermore, a camshaft housing 112 is connected to the roller frame 11 for the support of the camshaft 13.

The roller block 12 includes a leveling cassette 121 and a holster 122. The leveling cassette 121 is located close to the metal strip 5, and the cassette 121 has one or more closing cylinders facing the metal strip 5. The closing cylinder provides a convex contact surface 124 correspond to the shape of the metal strip 5. The holster 122 is connected to the other opposite end of the leveling cassette 121. There is a slide 1221 on the holster 122, and a slot on the leveling cassette 121, wherein the holster 122 and the cassette 121 are assembled to position the slide 1221 and slot to face each other to form a tunnel for the pass through of the camshaft 13.

Figure 7:
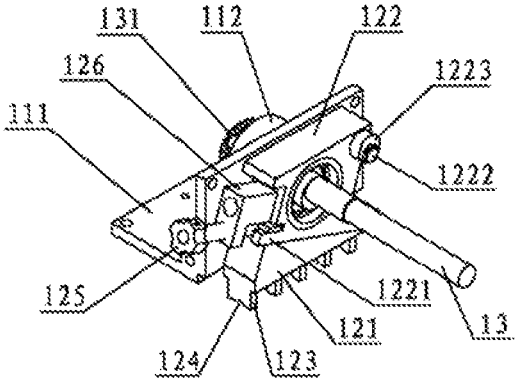
FIG. 7 shows a structural view of a roller block and an attached camshaft.
Figure 8:
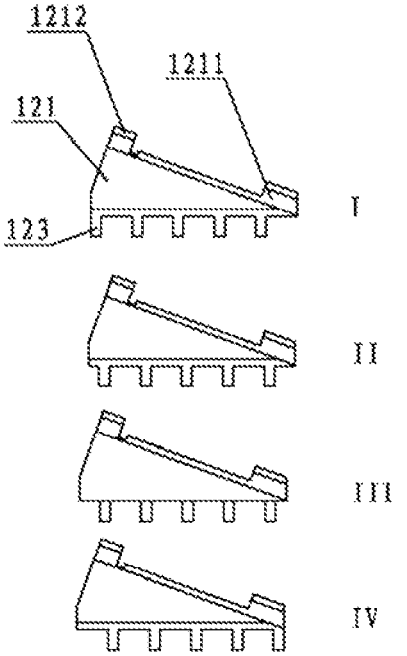
FIG. 8 shows a structural view of four roller blocks, each has an attached leveling cassette.

FIG. 7 and FIG. 8 illustrate a leveling gap control installed between the leveling cassette 121 and the holster 122, which is used to set the initial position of the leveling cassette 121. The leveling gap control includes a hole located on the holster 122 in parallel with axes to the slide 1221, and a bolt support with a slot 1211 located on the leveling cassette 121. The slot 1211 is a U-shaped slot, and an adjusting screw 125 goes through the slot 1211 to connect to the hole, and is held in place by using two outer knurled rings rigidly connected to both ends of the screw 125.

The holster 122 also has a adjusting housing 126 for the purpose of providing a maximum limit of range of movement for the adjusting screw 125. The adjusting housing 126 is located on the top of the holster 122, and is also used for the purpose to prevent the adjusting screw 125 from falling out of the holster 122.

For the purpose of stabilizing the roller blocks 12 during operation, in order to maintain balance and to reduce vibration, a support roller 1222 is installed onto the holster 122 in a position parallel to that of the camshaft 13 as shown in FIG. 7. The roller frame 11 has a hole for the support roller 1222 to go through and kept in position by attaching 2 bearings 1223, one on each end of the support roller 1222. Each bearing 1223 has a diameter slightly smaller than that of the hole. When the camshaft 13 actuates to drive the roller block 12 in motion, both the support roller 1222 and the bearings 1223 are also driven to move within the parameters of the hole, which in turn limit the range of movement, and thus reduce the vibration and increase accuracy of operation.

Figure 9:
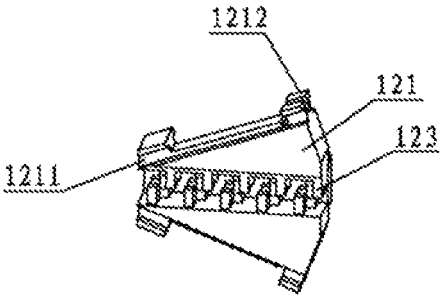
FIG. 9 shows a schematic view of four roller blocks assembled with their closing cylinders attached.
Figure 10:
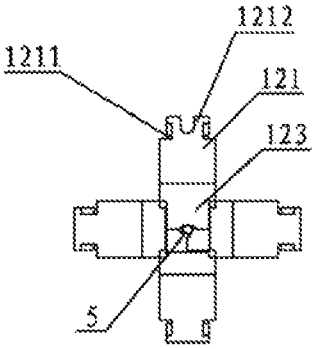
FIG. 10 shows a top down view of four roller blocks assembled.

FIG. 8, FIG. 9, and FIG. 10 illustrate various structural views of the four leveling cassettes 121. FIG. 8 shows a schematic view of how the leveling cassettes 121 of the same roller block 12 are connected in arrangement to follow and alternate with each other. With the four leveling cassettes 121 fully assembled and installed on the roller block 12, the four cassettes 121 assert pressure onto the metal strip 5 from four different angles into an upward full encirclement wrap. The convex contact surface 124 on the closing cylinders combine to provide a tunnel for the passage of the metal strip 5, as shown in FIG. 10. FIG. 9 shows the schematic view of the closing cylinders arranged to follow and alternate with each other, while at the same time linked to each adjacent cylinder. One purpose of using the closing cylinders is to stop the metal strip 5 from falling out and into the gap between the adjacent leveling cassettes 121 when the leveling cassettes 121 revert to a retracted position. Furthermore, by adjusting the initial position of any one of the leveling cassettes 121, all the linked leveling cassettes 121 are automatically adjusted to the same initial position, resulting in immediate and consistent adjustments to all cassettes 121.

FIG. 1 shows that alternate embodiments have been contemplated to connect the outfeed device 3 to the motorized drive system via the use of an additional leveling roller 21, in order to further facilitate the moving of the metal strip 5. Meanwhile, support rollers 1222 can also be installed in the infeed device 2 to provide even further assistance to the movement of the metal strip 5.

In FIG. 1 and FIG. 2, the preferred embodiment uses a motor 4 in combination with a belt drive connecting to a camshaft 13 as the motorized drive system. A sprocket 132 is used to connect a sprocket wheel that is rigidly attached to the camshaft 13, to another sprocket wheel 213 attached to the infeed device 2, consequently driving the leveling roller 21 in the infeed device 2 in rotation. Only one motorized drive system is used to drive both the camshaft 13 and leveling roller 21 in motion via the use of the various transmission systems, resulting in a simplified and more compact overall structure.

As seen in FIG. 1 and FIG. 2, the preferred embodiment is used in combination with a slitting machine 6 and a measuring mechanism 7 for a complete processing. The current invention finishes straightening the metal strip 5, forwards to the slitting machine 6 and the measuring mechanism 7 to cut the metal strip 6 to a desired length.

What is claimed is:

1. A straightening machine for straightening a metal strip, comprising:

a pressure frame;

a first feeding device having a leveling roller, wherein the first feeding device is attached to infeed side of the frame;

a second feeding device having a leveling roller, wherein the second feeding device is attached to an outfeed side of the frame;

a plurality of roller blocks each having a leveling cassette attached on the upper side of each roller block, and a holster attached on the lower side of each roller block, wherein a camshaft with saw teeth goes through a center of each holster;

wherein each leveling cassette has one or more closing cylinders each with a convex contact surface facing the metal strip, wherein each leveling cassette has a slot that faces a slide of a corresponding holster, wherein each roller block comprises a leveling gap control located in between the leveling cassette and the holster; and a motorized drive system, attached to the leveling roller of the first feeding device, to the leveling roller of the second feeding device, and to at least one camshaft of at least one roller block, wherein the roller blocks are arranged in a series located between the first feeding device and the second feeding device;

wherein the first feeding device is attached to the roller blocks at one end of the series;

wherein the second feeding device is attached to the roller blocks at an opposite end of the series;

wherein each roller block is connected to one or more adjacent roller blocks by connecting the closing cylinder in each roller block, wherein the convex contact surfaces of the connected closing cylinders creates a passage for the metal strip, wherein the motorized drive system drives the roller blocks into rotation, thereby moving the metal strip by friction to move toward direction of the outfeed side of the pressure frame through the center of the passage created by the convex contact surfaces, wherein the motorized system actuates the roller blocks by rotating the camshaft to move the metal strip through the passage created by the convex contact surfaces, alternating the roller blocks between a leveling position and a retracted position, thereby asserting pressure on the metal strip while at the leveling position, and releasing pressure while at the retracted position.

2. The device of claim 1, wherein the leveling gap control includes:

a hole located on the holster in parallel with axes to the slide; and a bolt support with the slot located on the leveling cassette, wherein:

an adjusting screw is connected to the hole by going through the slot.

3. The device of claim 2, wherein the slot is a U-shaped slot, and the adjusting screw is held in position by two outer knurled rings rigidly connected to both ends of the screw.

4. The device of claim 1, wherein the holster provides a hole to connect with a support roller, wherein the support roller is positioned in parallel to the camshaft by going through the hole, held in position with a bearing.

5. The device of claim 1, wherein four roller blocks are connected to position surrounding the metal strip, whereby each roller block is located at exactly a 90-degrees angle next to each adjacent roller blocks.

6. The device of claim 1, wherein the motorized drive system uses a belt transmission to connect with the camshaft, whereas the camshaft is connected to the leveling roller of the first device via a chain drive.

7. The device of claim 1, wherein the pressure frame includes a bearing block for support of the camshaft.

* * * * *